United States Patent [19]

Baker

[11] 4,430,214

[45] Feb. 7, 1984

[54] STRAINER MILL FOR SWIMMING POOL PUMP INTAKE

[76] Inventor: Marvin E. Baker, 815 Ewing Ave., Nashville, Tenn. 37203

[21] Appl. No.: 418,233

[22] Filed: Sep. 15, 1982

[51] Int. Cl.[3] ..... E04H 3/20

[52] U.S. Cl. ..... 210/169; 415/121 B; 119/158; 210/416.2

[58] Field of Search ..... 210/169, 173, 416.2; 119/158, 28; 4/DIG. 4; 415/121 B

[56] References Cited

U.S. PATENT DOCUMENTS 3,051,312 8/1962 Arge ..... 210/416.2

3,640,474 2/1972 Niedl ..... 210/174

FOREIGN PATENT DOCUMENTS 1607425 9/1969 Fed. Rep. of Germany ..... 210/174

*Primary Examiner*—Charles N. Hart

*Assistant Examiner*—Sharon T. Cohen

*Attorney, Agent, or Firm*—Harrington A. Lackey

[57] ABSTRACT

A strainer mill mounted in the intake opening of an impeller pump in a swimming pool water circulating system, including a perforated strainer plate mounted transversely of the flow path of water into the impeller pump and a rotary cutter mounted on an extension of the impeller shaft on the intake side and in close proximity to the strainer plate for shredding leaves and other debris received from the swimming pool before entering the impeller pump. The strainer mill is also characterized by a collector receptacle having a sump and an inlet and outlet mounted in the flow path between the swimming pool and the strainer mill for collecting heavier and harder particles which cannot pass through the perforated strainer plate and which are thrown back by the rotary cutter blade.

3 Claims, 5 Drawing Figures

STRAINER MILL FOR SWIMMING POOL PUMP INTAKE

BACKGROUND OF THE INVENTION

This invention relates to a swimming pool water circulating system, and more particularly to a strainer mill for the intake of a swimming pool impeller pump.

In a typical swimming pool water circulation system including a rotary impeller pump and a filter, a strainer housing or pot is mounted in the water intake line from the pool to the intake of the pump, and includes a screen or screen basket for straining the leaves and other debris before the water from the swimming pool enters the circulating pump, in order to protect the pump. Finer debris which passes through the strainer screen or basket is safe to pass through the impeller pump, and is subsequently removed in the filter, before the water is returned to the swimming pool. Examples of such strainer pots or baskets are disclosed in the following U.S. patents:

U.S. Pat. No. 3,051,312, to Arge, Aug. 28, 1962;
U.S. Pat. No. 3,363,764, to Whitaker, Jan. 16, 1968;
U.S. Pat. No. 3,542,201 to Belonger et al, Nov. 24, 1970.

In all of the above strainer systems, the strainer screen or basket must periodically be removed for discharge of the collected leaves and other debris, or the leaf pot must be flushed, as illustrated in the above Whitaker patent. If the leaves and other debris are left too long in the respective strainer housings, then the circulation of the pool water will be retarded, and the pump will have to work harder and expend unnecessary energy in circulating the pool water.

The following U.S. patents disclose various types of devices, not related to the circulation of swimming pool water, in which perforated plates or grates have been utilized with rotary cutters for comminuting solid particles into small enough particles for discharge through the perforated plaate or grate:

U.S. Pat. No. 2,421,066, to Howe, May 27, 1947;
U.S. Pat. No. 2,906,310, to Schnell, Sept. 29, 1959;
U.S. Pat. No. 3,323,650, to Kilbane, Jr., June 6, 1967.

In the Howe U.S. Pat. No. 2,421,066, a flood control system includes a grate for blocking the flow of certain sized solid materials through a by-pass conduit. The grate has parallel elongated slots through which the blades of a rotary cutter move in order to disintegrate the solid materials.

The Schnell U.S. Pat. No. 2,906,310 discloses a comminuting machine for agricultural products, particularly sausage.

The Kilbane, Jr. U.S. Pat. No. 3,323,650 discloses a marine chlorinator, in which solid materials from a marine toilet are macerated and treated with chlorine before discharge.

SUMMARY OF THE INVENTION

It is therefore an object of this invention to replace the conventional strainer housings, leaf pots, and screen baskets in the intake line for a swimming pool water circulation system, with a strainer mill of unique construction, which does not need to be serviced in order to periodically remove leaves and other debris from the strainer device.

The strainer mill made in accordance with this invention includes a perforated strainer plate disposed transversely of the water flow in the intake opening of a rotary impeller pump of a swimming pool water circulation system. The strainer mill also includes a rotary cutter bar fixed coaxially to an extension of the impeller shaft so that the cutter bar rotates in a plane parallel and adjacent to the upstream or intake side of the perforated plate. The cooperation of the cutter bar rotating adjacent the intake face of the perforated strainer plate shreds the leaves and reduces the size of other debris carried by the intake flow from the swimming pool sufficiently that the debris can pass through the small holes in the perforated strainer plate, for transport to the filter without damage or obstruction to the pump impeller.

The rotary cutter blade preferably is a flat straight bar having opposed sharp edges. The cutter blade may terminate at its free ends in cutter bit portions projecting axially away from the strainer plate. These cutter bit portions at the extremity of the cutter blade provide additional mass as well as additional leveraged force for impacting comparatively hard large objects, such as rocks, in order to disintegrate the rocks for passage through the strainer plate or for projecting the rocks back upstream.

The strainer mill made in accordance with this invention, further preferably includes a collector receptacle having a sump portion and inlet and an outlet, so that the collector receptacle can be connected in the fluid conduit between the swimming pool and the intake opening of the pump. Thus, any large hard particles projected by the cutter blade upstream may be collected in the sump of the collector receptacle. The collector receptacle can be emptied of its solid contents, but not nearly so often as conventional strainer screen assemblies.

DESCRIPTION OF THE PREFERRED EMBODIMENTS

Figure 1:
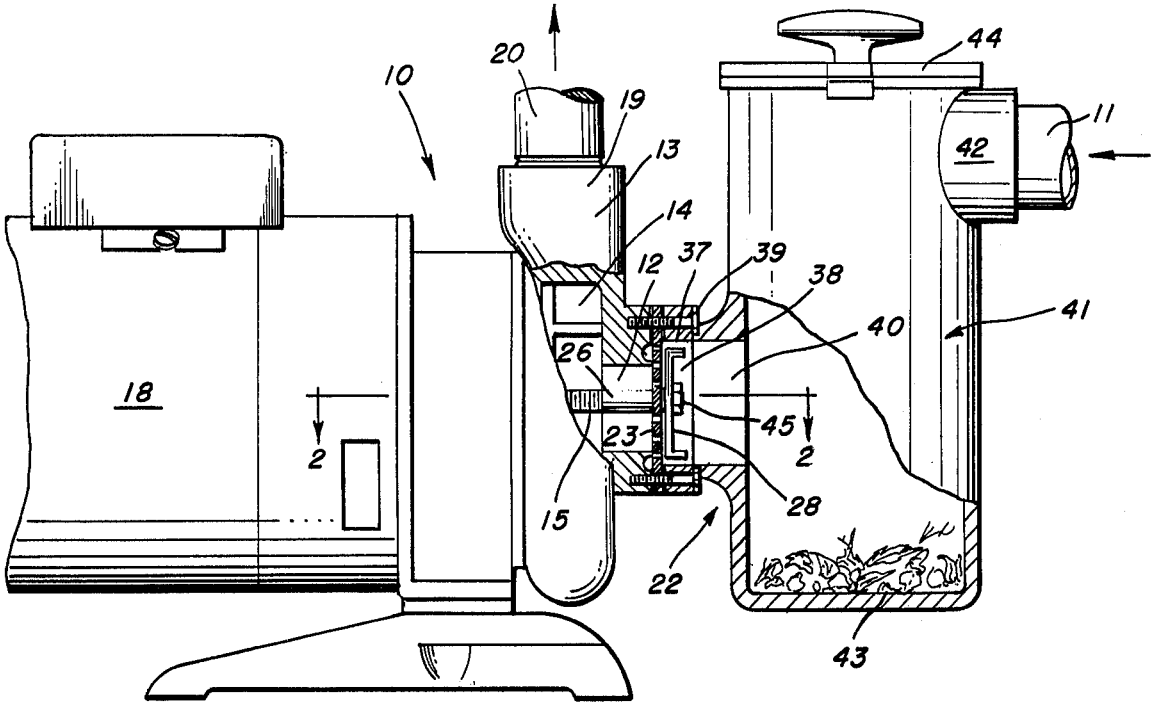
FIG. 1 is a fragmentary side elevation of a swimming pool circulation pump and a strainer mill, made in accordance with this invention, connected to the intake of the pump, with portions broken away and shown in section.
Figure 2:
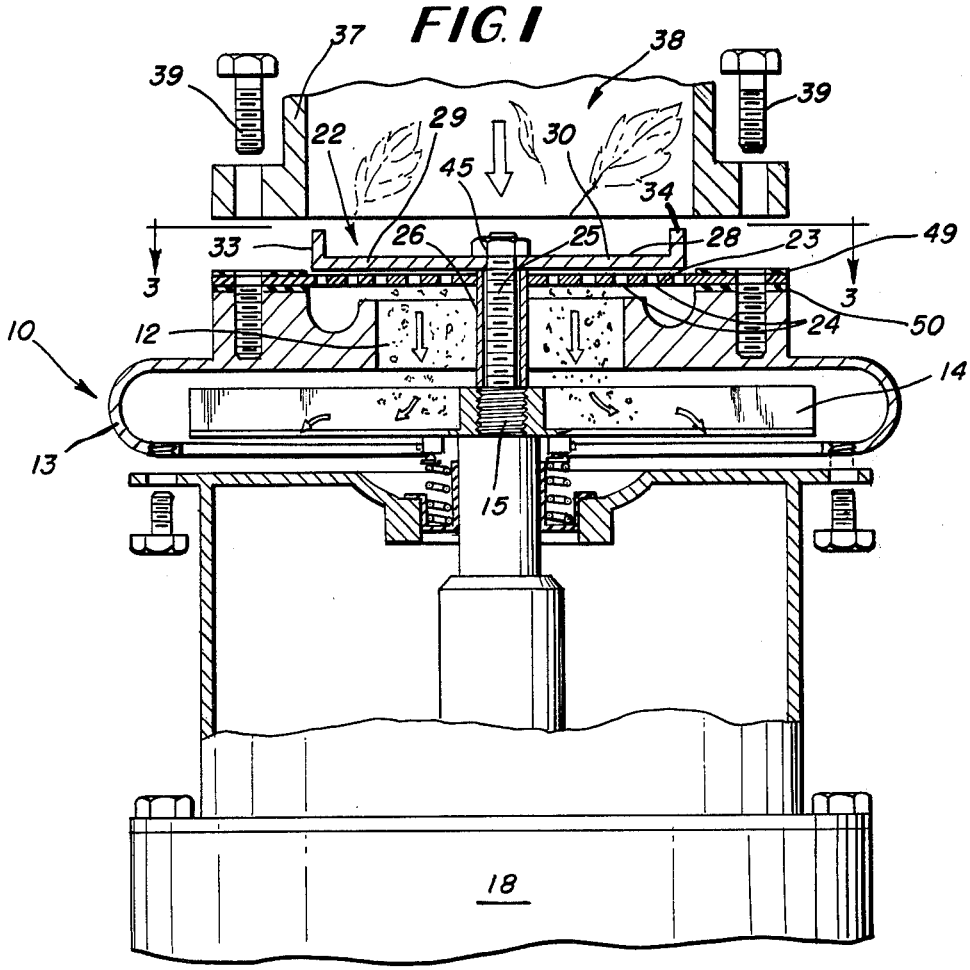
FIG. 2 is an enlarged, fragmentary telescopic sectional view taken along the line 2—2 of FIG. 1, in which the pump housing is of a slightly different size and shape.
Figure 3:
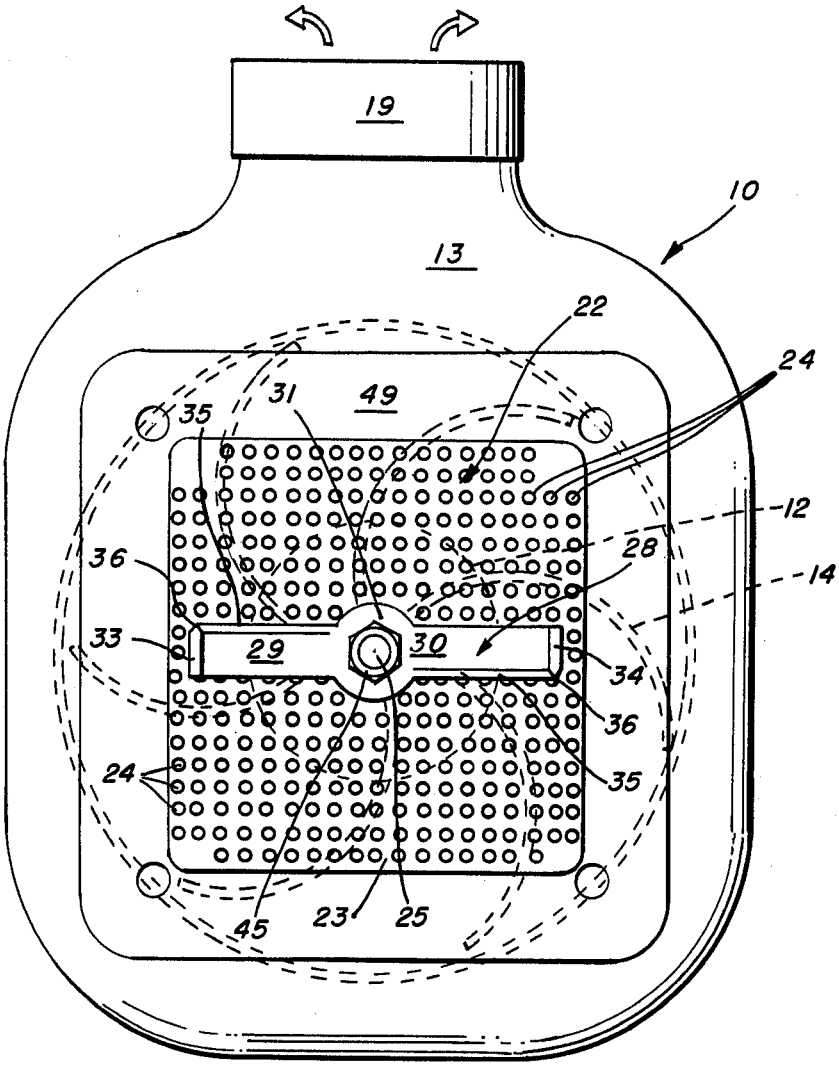
FIG. 3 is a section taken along the line 3—3 of FIG. 2.

Referring now to the drawings in more detail, FIG. 1 discloses a conventional centrifugal pump 10 for use in a swimming pool circulation system to pump water from the swimming pool, primarily from the main drain, not shown, and/or the skimmer, not shown, through the inlet conduit 11. The inlet conduit 11 is in fluid communication with the intake opening 12 formed in the pump housing 13, in which the rotary impeller 14 is mounted on the impeller shaft 15, driven by the electric motor 18. The impeller 14 discharges water from the pump housing 13 through its discharge outlet 19 and thence through the discharge conduit 20 to the filter, not shown, of the pool circulating system.

The strainer mill assembly 22 made in accordance with this invention includes a substantially planar strainer plate 23 having a plurality of flow holes 24 therethrough, and mounted to extend transversely of the flow path of the pool water through the intake opening 12. The flow holes 24 are preferably of a predetermined uniform size to block the passage of leaves and other debris, such as sticks, insects, lumps of clay, pebbles, and rocks, but to permit the free passage of the water from the swimming pool and certain minute solid particles which can be safely handled by the pump impeller 14.

Extending coaxially through a corresponding opening in the center of the perforated plate 23 is a cutter shaft 25 which forms a coaxial extension of the impeller shaft 15 and is adapted to have the same rotary motion as the impeller shaft 15. The cutter shaft 25 extends concentrically through an elongated spacer or bearing sleeve 26 which is fixedly mounted in the pump housing 13, and may be fixed to the strainer plate 23.

Fixed to the free end of the cutter shaft 25 is a cutter bar or blade 28 having equally and oppositely extending radial blade portions 29 and 30, radiating from a central hub portion 31 having a central opening, not shown, for receiving the cutter shaft 25.

The outer extremity of each blade portion 29 and 30 of the cutter bar 28 disclosed in FIGS. 1–4, terminates in a bit portion 33 and 34, respectively, which extends at substantially right angles to the planar blade portions 29 and 30 and axially away from the perforated strainer plate 23.

The leading edge 35 of each blade portion 29 and 30 and the leading edge 36 of each bit portion 33 and 34 are sharp to sever or fracture solid particles impacted by the respective blade portions 29 and 30 and bit portions 33 and 34.

The mass of the radial blade portions 29 and 30, as well as the bit portions 33 and 34, is equally distributed on radially opposite sides of the hub portion 31 to achieve rotary balance. As disclosed in FIG. 4, the blade portions 29 and 30 are of substantially uniform thickness, and also have the same width and thickness as the corresponding bit portions 33 and 34.

The cutter blade 28 is preferably confined within a peripheral wall portion 37 of a mill chamber 38, so that the tip or bit portions 33 and 34 are slightly spaced from the corresponding portions of the peripheral chamber wall 37. Accordingly, all solid particles which enter the mill chamber 38 will be confined to areas within the rotary path of the cutter blade 28, as these particles are carried toward the perforated strainer plate 23 by the flow of the pool water toward the intake opening 12 of the pump 10.

In a preferred form of the invention, the mill chamber 38 is secured to the pump housing 13 in fluid communication with the intake opening 12 by securing means, such as bolts 39 extending through registering bolt holes in flanges in the mill chamber 38 and in the pump housing 13. The bolts 39 may also extend through corresponding holes in the strainer plate 23 and gaskets 49 and 50, to secure the strainer plate 23, mill chamber 38 and pump housing 13 together in fluid-tight engagement, with a single set of bolts.

The mill chamber 38 is in fluid communication with, and may be formed as an integral part of, the outlet port 40 of a collector receptacle 41 (FIG. 1), which also has an inlet port 42 connected to the inlet conduit 11 from the swimming pool, not shown.

The collector receptacle 41 is preferably a completely enclosed housing having a bottom wall 43 which is below the outlet port 40 and the inlet port 42 so that heavier particles may gravitate to the bottom of the receptacle 41 and be collected upon the bottom wall 43. Although most solid particles will be flushed through the receptacle 41 by the force of the impeller pump 10, and most of the solid particles which enter the intake opening will be comminuted by the cutter blade 28 and pass through the flow holes 24 of the strainer plate 23, nevertheless any solid particles which are large and hard enough to not be comminuted, at least on first impact, will be thrown back into the receptacle 41 by the impact of these particles with the rapidly rotating cutter blade 28. In a typical centrifugal pump 10, the impeller 14, as well as the cutter blade 28, will be rotating at approximately 3,450 RPM.

The collector receptacle 41 preferably has an opening in the top thereof, closed by a registering cover member 44. Occasionally, when excessive solid particles have gravitated and collected on the bottom wall 43, the pump 10 may be stopped, the cover member 44 removed, and the solid particles extracted from the receptacle 41.

It is also within the scope of this invention to provide a trap or dump door in the bottom wall 43 to permit the solid particles to be occasionally withdrawn from the receptacle 41 when it is desired to remove such particles.

Since those particles which are harder, heavier, or more difficult to cut or fragment, will be forced radially outward by the centrifugal force of the cutter blade 28, the bit portions 33 and 34 constitute additional mass at the extremities of the blade 28 to provide greater strength and striking force at the periphery in order to encounter and disintegrate such heavier and larger particles.

Moreover, the bit portions 33 and 34 provide a greater striking area at the periphery of the mill chamber 38 in order to strike a greater number of particles in the periphery of the mill chamber 38, when otherwise such particles might slip by or pass over the blade portions 29 and 30 for a considerable time before being impacted.

The cutter shaft 25 may be externally threaded so that it may be removably secured to the cutter blade 28 by an internally threaded nut 45, if desired. Thus, if a cutter blade 28 becomes damaged or excessively worn, it may be easily removed for replacement by merely unthreading the nut 45 and removing the blade 28, after the mill chamber 37 has been removed from the pump housing 13 by removal of the threaded bolts 39.

Figure 5:
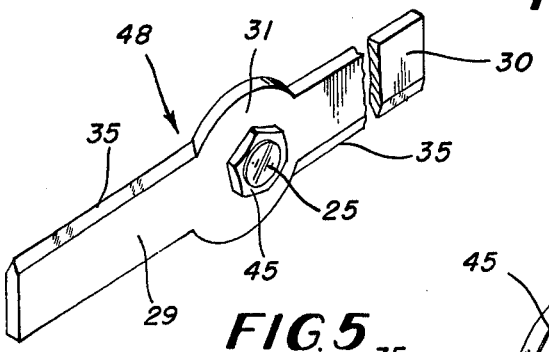
FIG. 5 is an enlarged perspective view of a second embodiment of the cutter blade, with portions broken away.
Figure 4:
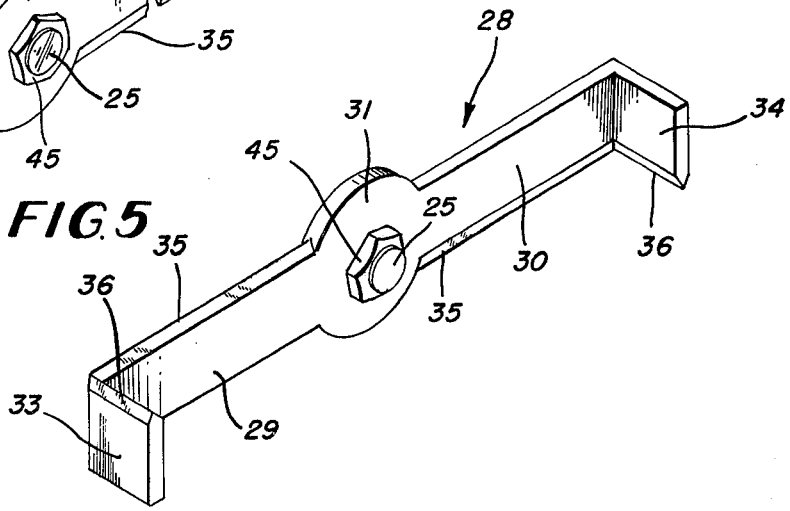
FIG. 4 is an enlarged perspective view of one embodiment of the cutter blade made in accordance with this invention.

FIG. 5 discloses a second embodiment of the cutter blade 48 having the same construction as the cutter blade 28, but without the bit portions 33 and 34. The blade portions 29 and 30 and the hub portion 31 of the cutter blade 48 are preferably of the same construction as their corresponding parts in the blade 28, including being substantially coplanar. The blade portions 29 and 30 of the blade 48 also are provided with the straight, radial, oppositely directed, leading sharp cutting edges 35 as the blade 28. The blade 48 is preferably the same length as the blade 28 so that the free ends of the blade portions 29 and 30 terminate closely adjacent the peripheral mill chamber wall 37, for substantially complete impact coverage of all the solid particles flowing through the mill chamber 38.

The cutter blade 48 will be able to comminute most solid particles encountered in the mill chamber 38. The blade portions 29 and 30 of the blade 48 could be made thicker than the corresponding blade portions of the blade 28 in order to compensate for the additional strength and impact force achieved by the blade 28 with its bit portions 33 and 34.

What is claimed is:

1. In a swimming pool water circulation system including a centrifugal pump having a rotary impeller shaft supporting an impeller, an intake opening coaxial with the impeller shaft and a discharge outlet, a strainer mill comprising:

(a) a planar strainer plate having a plurality of flow holes therethrough for the passage of water and spanning the intake opening of the centrifugal pump, said strainer plate having an intake face on the opposite side of said strainer plate from the pump impeller, (b) a cutter shaft member extending coaxially from the impeller shaft through said strainer plate, for rotary movement with said impeller shaft and relative to said strainer plate, (c) a cutter blade fixed to and extending radially from said cutter shaft member and spaced closely adjacent and spanning said intake face of said strainer plate, said cutter blade having a sharp leading edge and terminating in a radially outer extremity, (d) a mill chamber having an imperforate cylindrical wall concentric with said cutter shaft member and mounted adjacent said intake face and in fluid communication with said strainer plate, (e) said mill chamber receiving said cutter blade, the radius of said mill chamber being slightly greater than the distance from the axis of said cutter shaft member to said outer extremity, (f) a collector receptacle having an inlet in fluid communication with an intake conduit from a swimming pool, and an outlet in fluid communication with said mill chamber, (g) said receptacle having a bottom wall below said mill chamber for collecting debris by gravitation.

2. The invention according to claim 1 in which said bottom wall is spaced below said inlet.

3. The invention according to claim 1 in which said cutter blade comprises an elongated cutter bar having equal and opposite radial blade portions, each blade portion terminating in a radially outer extremity comprising a cutter bit portion projecting axially away from said strainer plate, the leading edge of each of said blade portions and said bit portions being sharp.

* * * * *